US009370952B1

(12) United States Patent
Myma

(10) Patent No.: US 9,370,952 B1
(45) Date of Patent: Jun. 21, 2016

(54) BIT PLANE IMAGING METHOD AND SYSTEM

(71) Applicant: Peter Nicholas Myma, Skokie, IL (US)

(72) Inventor: Peter Nicholas Myma, Skokie, IL (US)

( * ) Notice: Subject to any disclaimer, the term of this patent is extended or adjusted under 35 U.S.C. 154(b) by 37 days.

(21) Appl. No.: 13/974,035

(22) Filed: Aug. 22, 2013

Related U.S. Application Data

(60) Provisional application No. 61/692,599, filed on Aug. 23, 2012.

(51) Int. Cl.

| | |
|---|---|
| ***B41J 29/38*** | (2006.01) |
| ***B41J 2/005*** | (2006.01) |
| ***B41J 2/045*** | (2006.01) |
| ***B41J 29/393*** | (2006.01) |

(52) U.S. Cl.
CPC ..... *B41J 29/38* (2013.01); *B41J 2/0057* (2013.01); *B41J 2/0458* (2013.01); *B41J 29/393* (2013.01)

(58) Field of Classification Search
CPC ..... B41J 29/393; B41J 2/0458; B41J 2/0057; B41J 29/38
USPC ..... 347/9–19, 110
See application file for complete search history.

(56) References Cited

U.S. PATENT DOCUMENTS

| | | | | |
|---|---|---|---|---|
| 6,906,825 | B1 * | 6/2005 | Nakahara et al. | 358/1.9 |
| 7,798,589 | B2 * | 9/2010 | Torii | 347/12 |
| 2002/0063746 | A1 * | 5/2002 | Suzuki et al. | 347/19 |
| 2007/0200794 | A1 * | 8/2007 | Mueller et al. | 345/55 |

* cited by examiner

*Primary Examiner* — Julian Huffman
*Assistant Examiner* — Jeremy Delozier

(57) ABSTRACT

The present invention relates to the production of continuous tone imagery. It enables the printing of images sharper and more finely modulated than what can be currently produced with an ink jet, photo-mechanical, xerographic or any other non-continuous tone form of printing. In an embodiment, through the use of successive transfers of ink of intermediate value, a much finer gradation at a higher resolution can be achieved. The pattern of transfers is based on the binary system to achieve the highest quality with the fewest transfers and can be used with any non-continuous tone form of printing. In a further embodiment, ink transfers between media of substantially equal ink affinity can be sequenced in a binary manner through simultaneous transfer and withdrawal of inks. Additional embodiments include a means of regulating ink transfer to achieve a binary layer construction of an image.

37 Claims, 5 Drawing Sheets

BIT PLANE IMAGING METHOD AND SYSTEM

CROSS REFERENCE TO RELATED APPLICATIONS

This application claims priority to U.S. Provisional Application No. 61/692,599 filed on Aug. 23, 2012, the entire contents of which are incorporated herein by reference.

FEDERALLY SPONSORED RESEARCH

None

FIELD OF THE INVENTION

The present invention relates to the production of continuous tone imagery.

BACKGROUND OF THE INVENTION

The human eye is a keen optical observer. It has the ability to distinguish very fine detail and subtle changes in tonal value. In imaging, fine modulation is the goal, as life-like images have greater impact. Most photo-mechanical and digital reproduction processes seek to maximize this ability. Silver-gelatin emulsions were highly successful in this regard, being capable of producing images of greater sharpness and gradation than the eye can see at normal viewing distances.

The loss of most silver-gelatin processes for the more convenient ink jet process has made this quality shortfall visible. Ink jet printers are inherently incapable of producing continuous-tone images. Instead, they must be simulated through a system of dithering, that is, simulating intermediate tonal values through the spacing of full-tone dots. This is an inherent trade-off of sharpness for gradation because a sufficient area is required for the ink jet dots to provide an adequate range of intermediate tonal values. These intermediate values often lack subtlety and can display visible banding at tonal transitions.

Ink jet printers are of a closed, proprietary nature, making any modification to overcome their inherent limitations difficult. The process by which they simulate continuous tones as well as the inks are complex and not always fully disclosed. What is needed is a process that can take the widely available ink jet printer and modify it to increase its sharpness and gradation.

Photo-mechanical, xerographic and all other non-continuous tone printing processes analogously suffer from tonal and sharpness fidelity problems. When the primary means of modulation is the size, shape or spacing of the ink dots, the inability to print at sufficiently high resolution diminishes the ability to finely modulate tone and delineate precise detail. What is also needed is a process that can take the widely available photo-mechanical, xerographic or any other non-continuous tone form of printing and modify it to increase its sharpness and gradation.

BRIEF SUMMARY

The present invention relates to the production of continuous tone imagery. It enables the printing of images sharper and more finely modulated than what can be currently produced with an ink jet, photo-mechanical, xerographic or any other non-continuous tone form of printing. In an embodiment, through the use of successive transfers of ink of intermediate value, a much finer gradation at a higher resolution can be achieved. The pattern of transfers is based on the binary system to achieve the highest quality with the fewest transfers and can be used with any non-continuous tone form of printing. In a further embodiment, ink transfers between media of substantially equal ink affinity can be sequenced in a binary manner through simultaneous transfer and withdrawal of inks. Additional embodiments include a means of regulating ink transfer to achieve a binary layer construction of an image.

Further embodiments, features and advantages of the invention, as well as the structure and operation of the various embodiments of the invention are described in detail below with reference to the accompanying drawings.

BRIEF DESCRIPTION OF THE DRAWINGS/FIGURES

DETAILED DESCRIPTION OF THE EMBODIMENTS

Figure 1:
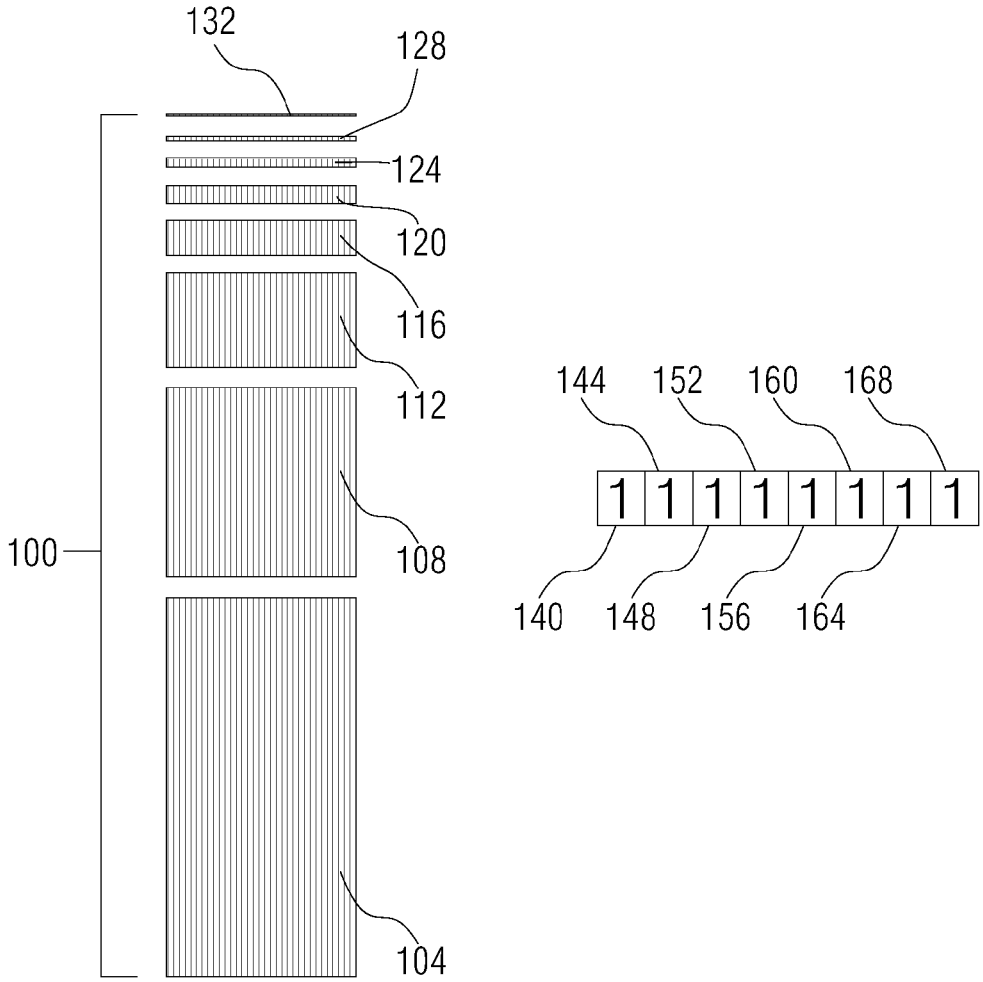
FIG. 1 is an exploded view diagram that illustrates the relationship between bit plane ink contribution and the binary image value according to an embodiment of the present invention.

The present invention relates to the production of continuous tone imagery. In the detailed description of the invention that follows, references to "an embodiment", "various embodiments", "a further embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described.

The term "ink" as used in the description and the claims of the present invention can be defined as any colorant consisting of light modulating materials. The ink may reside on the surface or in a layer coated on the surface, or be absorbed into the structure of the printed medium. Inks can be toner, dyes or pigments, or inks can be chemically, optically or thermally formed in place, or inks can be chemically, optically or thermally removed. Inks modulate light through any combination of reflectance, transmission, interference, electrochemical, polarization, fluorescence or luminescence. A "non-opaque" ink as used in the description and the claims of the present invention can be defined as any ink that does not completely obscure any previously applied ink.

The term "affinity" as used in the description and the claims of the present invention can be defined as the receptivity of a layer to attract and retain ink. High affinity denotes a high receptivity to inks that are taken up faster or more completely from a donor layer to a receptor layer. For example, an ink attractor such as, but not limited to, a cationic polymer will increase the ink affinity of an ink jet layer. Substantially equal ink affinity denotes a similar degree of receptivity in the similar time frame for both donor and receptor layers. Substantially equal ink affinity layers brought in contact, optionally with the use of a solvent to make the ink flow, will leave substantially equal amounts of ink, also referred to as "half" or "halved," in both donor and receptor layers. Substantially equal ink affinity layers will be comprised of layers that are similar in one or more of thickness, permeability and absorbency to ink. An ink transfer between layers of substantially equal ink affinity will yield a density at a standard transfer time that is at least half of the density at a maximum transfer time. This density is the standard logarithmic measure of optical opacity traditionally employed by the photographic industry in dealing with silver-gelatin emulsions. A standard transfer time is the time it takes to uniformly transfer most of the ink that can be transferred between two layers. The maximum transfer time is a time long enough to transfer most of the ink that an infinite transfer time would transfer between two layers. A low ink affinity denotes a receptor layer that takes up ink slowly or incompletely.

The term "bit plane" as used in the description and the claims of the present invention is a single digit in a binary number's series of yes/no values. Each successive digit represents twice the value of the last digit. All the digits combined as a sum make the total number value, and represent the value range possible for a binary-encoded image. The least significant bit is the lowest value digit. The most significant bit is the highest value digit. An unset digit has the value of zero ("0"). These bit values can range from one ("1") for the least significant bit to one more than half the total binary number value for the most significant bit. At least two bits are required. The "least significant bit plane" is the bit plane with an associated concentration of ink that is controlled by the least significant bit of a binary number representation of image values. The "most significant bit plane" is the bit plane for an associated concentration of ink that is controlled by the most significant bit of a binary number representation of image values.

The term "donor layer" as used in the description and the claims of the present invention is a layer containing ink to be transferred to another layer that is capable of taking up that ink. The term "receptor layer" as used in the description and the claims of the present invention is a layer taking up ink directly from a printer or indirectly from another layer. Ink can be taken up in the layer or deposited on top of the layer. Layers can function as donor or receptor, or both simultaneously. Layers can be coated on a support or be integrated into the structure of the support. The term "solvent" as used in the description and the claims of the present invention is a liquid in which the ink can be suspended, allows ink to flow and that facilitates the transfer of ink from one layer to another. An example for water-based inks can be, but is not limited to, water or water mixed with isopropyl alcohol. An example for volatile compound-based inks can be, but is not limited to, various ketones.

The term "halftone" as used in the description and the claims of the present invention is a way of simulating continuous tones with solid areas of ink. This is usually done in the graphic arts by breaking or "screening" the image into small dots, and varying the size or shape of these dots. Alternatively, a continuous tone can be simulated by the relative frequency of solid color dots. This frequency of "dithered" dots can be in a fixed block or randomly distributed along a tonal transition, and both are commonly employed in ink jet printing. Screening or dithering are "intermittent" patterns of laying down full concentrations of ink that appear to the eye effectively as a lower concentration of ink. All non-continuous tone printing processes must use some form of halftoning if continuous tone imagery such as, but not limited to, photographs are to be reproduced.

The term "printing plate" as used in the description and the claims of the present invention refers to any single or multiple-use medium to transfer an ink image to a final medium.

The term "tonal value" as used in the description and the claims of the present invention refers to the brightness value for any area in an image and can range from zero through and including the maximum value. When there are multiple colors in an image, each image area can have separate tonal values for each of these colors. When the ratio of colors specifies the hue of the image area, those colors are considered "primaries."

Ranges are assumed to be inclusive, that is, "10-40" or "10 through 40" includes the initial and terminal elements 10 and 40 respectively, as well as all the numbered elements in between.

The above definitions and examples are strictly illustrative and do not limit the present invention.

The present invention relates to the production of continuous tone imagery. It enables the printing of images sharper and more finely modulated than what can be currently produced with an ink jet, photo-mechanical, xerographic or any other non-continuous tone form of printing. In an embodiment, through the use of successive transfers of ink of intermediate value, a much finer gradation at a higher resolution can be achieved. The pattern of transfers is based on the binary system to achieve the highest quality with the fewest transfers and can be used with any non-continuous tone form of printing. In a further embodiment, ink transfers between media of substantially equal ink affinity can be sequenced in a binary manner through simultaneous transfer and withdrawal of inks. Additional embodiments include a means of regulating ink transfer to achieve a binary layer construction of an image.

FIG. 1 is an exploded view diagram that illustrates the relationship between bit plane ink contribution and the binary image value according to an embodiment of the present invention. The image value for a given point in the image is specified in the binary number whose digits are 140 through and including 168. The ink segments 104 through and including 132 comprise the bit plane components of a maximum deposit 100. The height of the ink segment 104 through and including 132 indicates the amount of ink present, referred to as its quantity, density or concentration. All inks are non-opaque and thus the combined presence of more than one bit plane's ink will absorb more light than any one of those bit planes' inks separately. Ink segment 104 is a bit plane that corresponds to the most significant bit 140. Ink segment 108 is half the value of ink segment 104 and every further ink segment through and including 132 is half the value of its predecessor's value.

Bit planes 108 through and including 132 correspond to bit positions 144 through and including 168 respectively. 140 is the most significant bit and controls the ink quantity 104. 144 is the second most significant bit and controls the ink quantity 108. 148 is the third most significant bit and controls the ink quantity 112. 152 is the fourth most significant bit and controls the ink quantity 116. 168 is the least significant bit and controls the ink quantity 132. 164 is the second least significant bit and controls the ink quantity 128. 160 is the third least significant bit and controls the ink quantity 124. 156 is the fourth least significant bit and controls the ink quantity 120. The more significant the bit, the higher the associated ink concentration. Although this diagram shows eight bit planes, any plural quantity of bit planes can be used. The higher the amount of bit planes, the higher the quality of the image.

Figure 2:
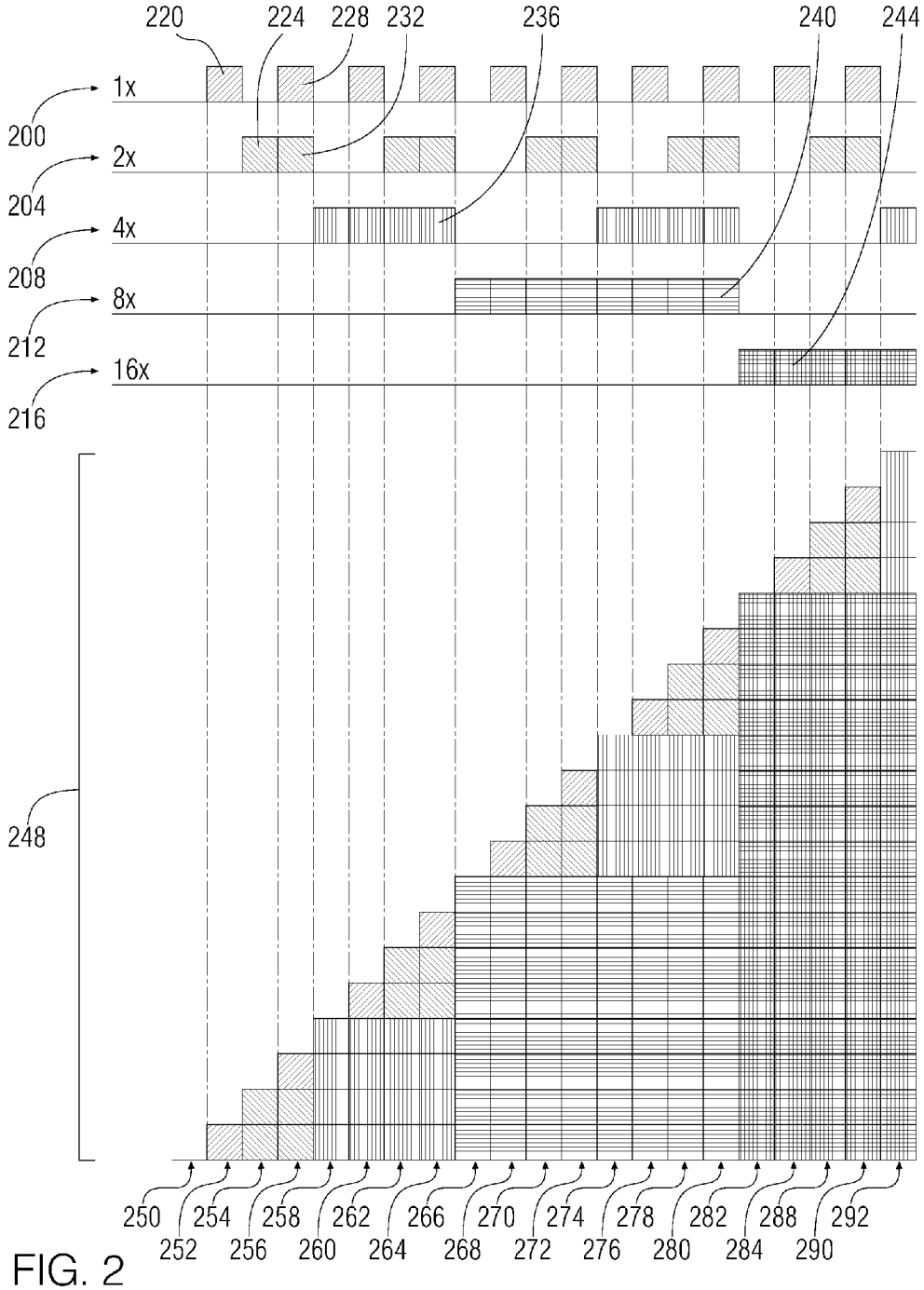
FIG. 2 is a schematic that illustrates the binary ink layer composition of an image value progression according to an embodiment of the present invention.

FIG. 2 is a schematic that illustrates the binary ink layer composition of an image value progression according to an embodiment of the present invention. Rows 200 through and including 216 show the bit planes one through and including sixteen. Each bit plane has its own hatching for bits that are set to being visible. Each bit plane can contribute one to sixteen bits that are accumulated in the value progression below in the rows of 248. Columns 250 through and including 292 show the ink accumulation for the rows 248 as an image of a stepped tonal gradient, progressing from the value of zero and reaching twenty. Each hatched square in the image found in rows 248 represents a value of one bit and the total value is accumulated vertically for each column from 250 through and including 292.

Bits in rows 200 set one bit in the image as seen in the rows 248 in the lower part of the schematic. Bits in rows 204 set two bits in the image as seen in the rows 248 in the lower part of the schematic. Bits in rows 208 set four bits in the image as seen in the rows 248 in the lower part of the schematic. Bits in rows 212 set eight bits in the image as seen in the rows 248 in the lower part of the schematic. Bits in rows 216 set sixteen bits in the image as seen in the rows 248 in the lower part of the schematic. The bits are accumulated in columns 250 through and including 292 and increasing bit totals correspond to increasing ink amounts or concentration in the printed image.

For example, 220 is a bit set on the 1x bit plane of 200 and adds a value of one to the total value accumulation in column 252 for rows 248. In another example, 224 is a bit set on the 2x bit plane of 204 and adds a value of two to the total value accumulation in column 254 for rows 248. In a further example, 228 is a bit set on the 1x bit plane of 200 along with bit 232 set on the 2x bit plane of 204 and both set bits add a value of three to the total value accumulation in column 256 for rows 248.

The individual bits in rows 248 have hatching that match the hatching of bits set in their corresponding bit planes in rows 200 through and including 216. 236 represents a bit set on the 4x bit plane and the total in column 264 for rows 248 contains four bits that match the 4x row 208 type along with three other bits matching those set in rows 200 and 204. The total set bits corresponding to the total ink in column 264 for rows 248 is seven. 240 represents a bit set on the 8x bit plane and the total in column 280 for rows 248 contains eight bits that match the 8x row 212 type along with seven other bits matching those set in rows 200 through and including 208. The total set bits corresponding to the total ink for column 280 is fifteen. 244 represents a bit set on the 16x bit plane and the total in column 284 for rows 248 contains sixteen bits that match the 16x row 216 type along with one other bit matching the one set in row 200. The total value accumulation of bits corresponding to the total ink in column 284 for rows 248 is seventeen. There are no bits set in column 250.

The bit plane combination of the image is valid for any plural number of bits. In an embodiment, the more bit planes similar to those shown in rows 200 through 216 of FIG. 2, the higher the quality of the image in terms of sharpness and gradation.

Figure 3:
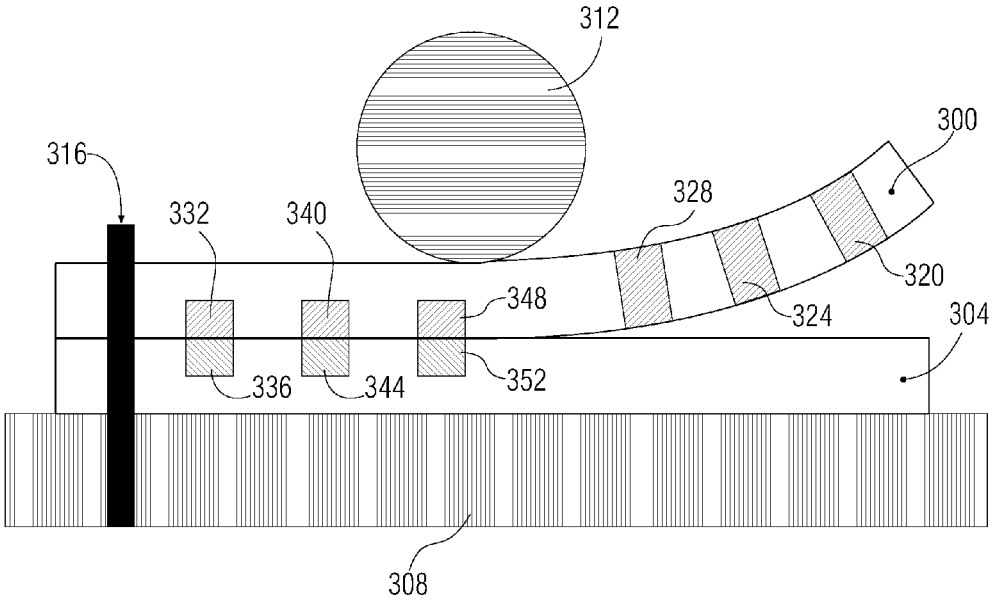
FIG. 3 is a magnified side view diagram that illustrates in-register contact ink transfer between media of substantially equal ink affinity according to an embodiment of the present invention.

FIG. 3 is a magnified side view diagram that illustrates in-register contact ink transfer between media of substantially equal ink affinity according to an embodiment of the present invention. The diagram is a simplified view that shows layers with an affinity for ink and not any structural backing or support which have been omitted for clarity. 300 is an ink donor layer. 304 is an ink receptor layer. A mirror image will need to be used with an odd number of image transfer generations, using intermediate transfer layers for more than one generation.

In an embodiment, 308 is a rigid flat base to support the layers during one or more transfers. A register pin 316 is used to transfer all bit plane images in register with each other. Other embodiments include the use of one or more rollers 312 on one or more sides of the donor/receptor pair. With two 312 rollers and no rigid base such as 308, registration can be maintained in an embodiment by alignment of the donor and receptor layer's edges.

Ink areas 320, 324 and 328 are areas of ink in the donor layer 300 that have yet to be brought into contact with the receptor layer 304. These ink areas are at full strength, still contained entirely within the donor layer 300. Donor ink areas 332, 340 and 348 in the donor layer 300 have partially transferred to a receptor layer 304 of equal ink affinity to areas 336, 344 and 352 respectively. After transfer, a substantially equal amount of ink has transferred from 332 into 336, as has ink area 340 into 344 and ink area 348 into 352. After transfer, the donor layer is removed and further transfers from another donor layer can take place in a similar manner for as many transfers as there are bit planes to print.

Other embodiments can include the transfer of ink between layers of unequal affinity. When receptor layer 304 has a higher affinity for ink than does donor layer 300, more ink will transfer from areas 332, 340 and 348 from the donor layer 300 into areas 336, 344 and 352 respectively, in the receptor layer 304. This affinity can be matched to ink concentration required by a given bit plane. In a further embodiment, the time and the temperature of the base 308 can be used to vary the degree of ink transferred from donor layer 300 into receptor layer 304. In another embodiment, solvents can be employed to facilitate transfer between donor layers and receptor layers.

In another embodiment, a donor layer 300 contains no ink to transfer. After contact, ink will flow back from a receptor layer 304 into the donor layer 300. In this case, whatever ink that was transferred into 304 will be further reduced through the time, temperature and affinity of the donor layer 300. In further embodiments, many levels of ink concentration are possible through the partial transfer and subsequent withdrawal of inks between donor and receptor layers, regulated by the number of transfers, as well as by the conditions of transfer, as well as by the relative affinity between one or more donor layers to the receptor layer. A receptor layer can become a donor layer to a further receptor layer. A donor layer can become a receptor layer when it has any affinity for ink.

Another embodiment is the use of bit plane printing plates. Printing plates are created for each bit plane. Ink concentrations corresponding to bit plane positions are printed with successive plates in register.

Figure 4:
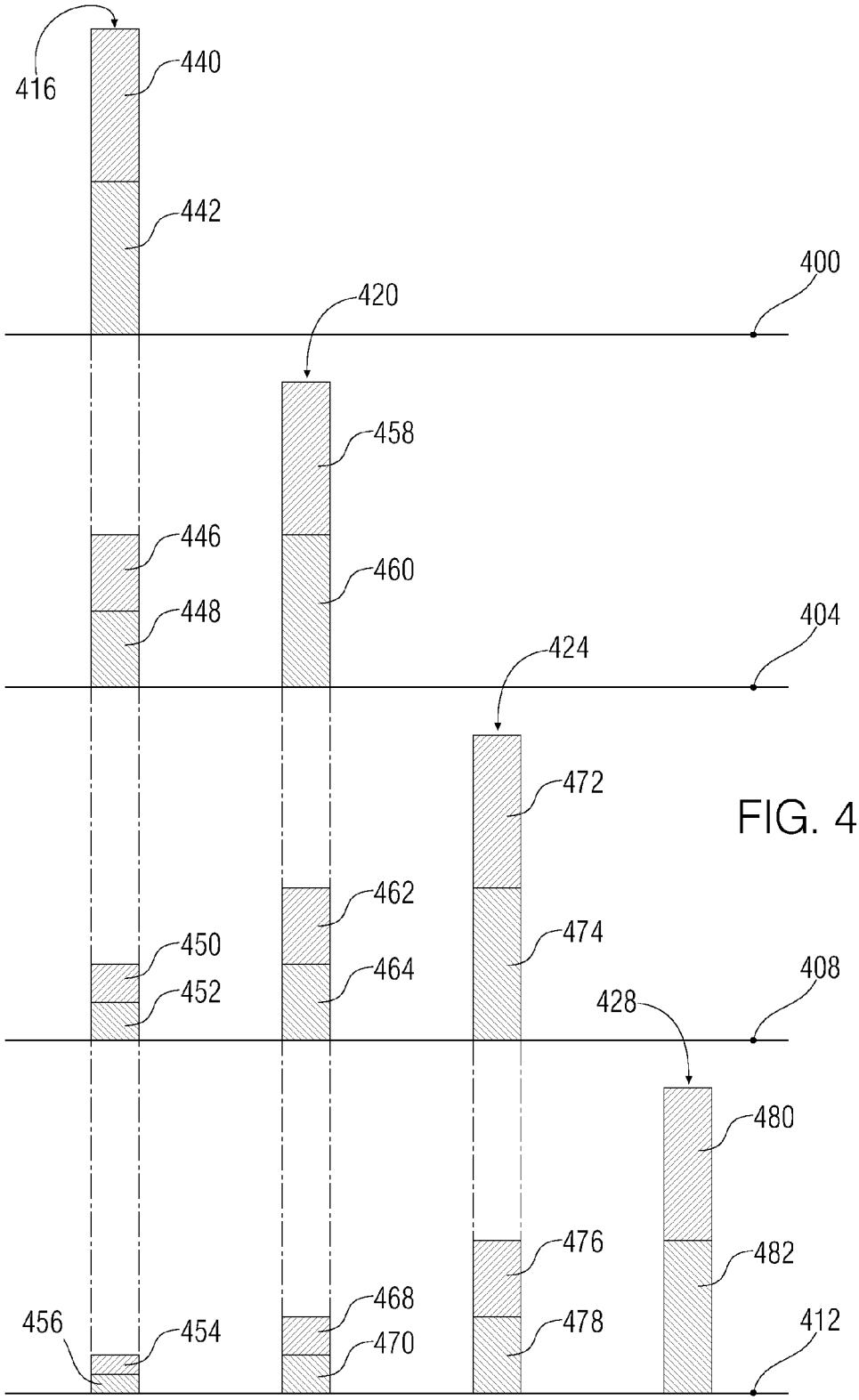
FIG. 4 is a diagram of a sequence of ink transfers that yields a bit plane series of ink concentrations when using transfer layers of substantially equal ink affinity according to an embodiment of the present invention.

FIG. 4 is a diagram of a sequence of ink transfers that yield a bit plane series of ink concentrations when using transfer layers of substantially equal ink affinity according to an embodiment of the present invention. The sequence consists of as many transfers as there are bit planes. In an embodiment, each of the four donor layers in FIG. 4 contains the same initial amount of ink for each bit plane at the same ink concentration. A new donor layer is printed with the ink from a different bit plane shown in columns 416, 420, 424 and 428 for each transfer onto a single receptor layer in the transfers 400, 404, 408 and 412 respectively and in that order. The four bit planes, from the least significant bit to the most significant bit, representing the bit planes of the lowest to the highest ink concentration, are columns 416, 420, 424 and 428 respectively. The four transfers follow the sequence 400, 404, 408 and 412. Each transfer deposits ink in the receptor layer and withdraws existing ink into a donor layer. The ink rectangles are 440 through and including 482. A greater ink concentration is indicated by a taller ink rectangle. 456 has half the ink of 452, just as 452 has half the ink of 448, just as 448 has half the ink of 442.

The relative ink concentrations in the donor and receptor layers after the first transfer are shown in 400. For the least significant bit plane in column 416, 440 is the ink remaining in the donor layer and 442 is the ink transferred to the receptor layer. The ink amounts are substantially evenly divided when the donor layer and receptor layer have a substantially equal ink affinity.

The relative ink concentrations in the donor and receptor layers after the second transfer are shown in 404. The least significant bit plane's ink 442 from the first transfer 400 is further divided during the second transfer 404, with half going back into the donor layer 446 and half remaining in the receptor layer 448. The second least significant bit plane's ink amount in column 420 is substantially equally divided between donor layer 458 and receptor layer 460.

The relative ink concentrations in the donor and receptor layers after the third transfer are shown in 408. The least significant bit plane's ink 448 from the second transfer 404 is further divided during the third transfer 408, with half going back into the donor layer 450 and half remaining in the receptor layer 452. The second least significant bit plane's ink 460 from the second transfer 404 is further divided during the third transfer 408, with half going back into the donor layer 462 and half remaining in the receptor layer 464. The second most significant bit plane's ink amount in column 424 is equally divided between donor layer 472 and receptor layer 474.

The relative ink concentrations in the donor and receptor layers after the fourth transfer are shown in 412. The least significant bit plane's ink 452 from the third transfer 408 is further divided during the fourth transfer 412, with half going back into the donor layer 454 and half remaining in the receptor layer 456. The second least significant bit plane's ink 464 from the third transfer 408 is further divided during the fourth transfer 412, with half going back into the donor layer 468 and half remaining in the receptor layer 470. The second most significant bit plane's ink 474 from the third transfer 408 is further divided during the fourth transfer 412, with half going back into the donor layer 476 and half remaining in the receptor layer 478. The most significant bit plane's ink amount in column 428 is substantially equally divided between donor layer 480 and receptor layer 482.

After the fourth transfer 412, the least significant bit plane's ink found in column 416 has been halved four times and contains half the ink in 456 of the next more significant bit plane as found in 470 in column 420. After the fourth transfer 412, the second least significant bit plane found in column 420 has been halved three times and contains half the ink in 470 of the next more significant bit plane as found in 478 in column 424. After the fourth transfer 412, the second most significant bit plane's ink found in column 424 has been halved two times and contains half the ink in 478 of the next more significant bit plane as found in 482 in column 428. After the fourth transfer 412, the most significant bit plane's ink found in column 428 has been halved once and contains half the ink originally in the donor layer, the total quantity found in the donor layer before transfer being the sum of 480 and 482.

In another embodiment, a receptor layer can have a higher affinity for ink than a donor layer enabling precise control over the ink quantity transferred through the use of one or more of time, temperature or the availability of ink solvents. This control can take place at the same time of ink transfer or be applied between transfers. Allowing the transfer to a receptor layer of greater affinity to go to completion could yield a complete transfer of ink from the donor layer into the receptor layer. Control applied before or during transfer could slow or interrupt the complete transfer to obtain the exact quantity of ink desired. In a further embodiment, the ink amount could be measured as it was being transferred. These controls could also be used to accelerate the transfer process. In another embodiment, donor layers in later transfers can have lower ink affinity to increase the total maximum density of the transferred ink in the final receptor layer.

In another embodiment, donor layers can be reused. Because they have already been used, and their inks are at a lower concentration, the transfer or printing of a special image directly on the final receptor layer is needed. This special image would be a mirror image relative to the donor layer to be reused. This special layer is printed at the same ink concentration as it would have been printed onto its donor layer. This special image is the next most significant bit plane than is visible in the donor layer to be reused. Once the special image is printed, donor layers more significant than the special image's bit plane would be recreated and transferred in order of increasing bit significance in register with the special image.

Figure 5:
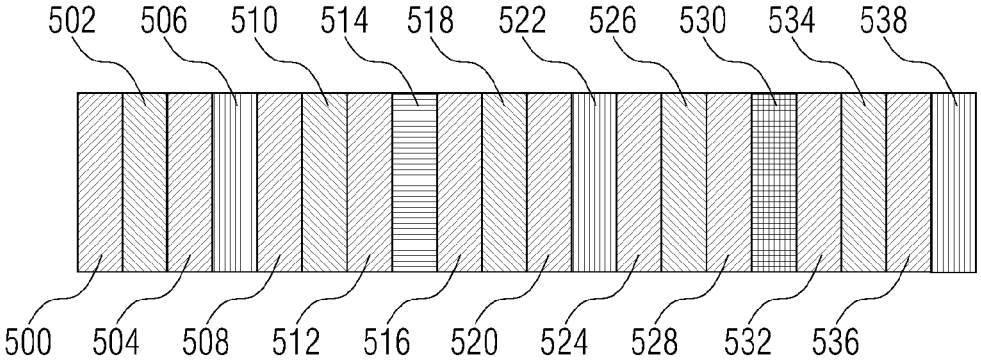
FIG. 5 is a top view diagram that illustrates the sequence of bit planes across an image value progression according to an embodiment of the present invention.

FIG. 5 is a top view diagram that illustrates the sequence of bit planes across an image value progression according to an embodiment of the present invention. It is a top view of the value progression 248 shown in FIG. 2. Each step adds a value of one to the initial step 500 which starts at a value of one, culminating in a value of twenty in step 538. These steps 500-538 correspond to the least significant bit present in the columns 252-292 of FIG. 2. The least significant bit planes shown represent only a part of the total image value for that step. The most frequently present least significant bit plane is the least significant bit and can be found in the ten steps 500, 504, 508, 512, 516, 520, 524, 528, 532 and 536. The second most frequently present least significant bit plane is the second least significant bit and can be found in the five steps 502, 510, 518, 526 and 534. The third most frequently present least significant bit plane is the third least significant bit and can be found in the three steps 506, 522 and 538. The fourth most frequently present least significant bit plane is the fourth least significant bit and can be found in the step 514. The fifth most frequently present least significant bit plane is the fifth least significant bit and can be found in the step 530. Step 530 appears once in sixteen steps whereas step 514 appears already in the eighth step, and thus appears more frequently than 530 due to the value progression not being displayed in its entirety up to the maximum value of thirty-one for five bit planes. The top view of the value of zero for column 250 in FIG. 2 is omitted in FIG. 5.

The use of fewer bit planes can be enabled by the dithering or halftoning of the least significant bit planes. The least significant bit planes occur the most frequently because they are present at every tonal transition as shown in the ten steps 500, 504, 508, 512, 516, 520, 524, 528, 532 and 536 of FIG. 5. Because they represent the least significant bit planes, they contain the least ink and therefore are the most difficult to see when dithered or halftoned. Dithering, halftoning or otherwise intermittently patterning a layer can reduce its effective ink concentration and create a virtual bit plane of a lower bit significance than the real bit plane ink concentration it is printed with. This patterning can take place at several different degrees of coverage and therefore yield multiple virtual bit planes, each at a lower significance bit level. Multiple virtual bit planes can be realized with a single real ink concentration by varying that single ink's degree of coverage. Virtual bit planes can be used to extend bit plane series into bit planes of lower bit significance as well as fill the gap between widely spaced bit planes of higher bit significance.

The Detailed Description section, and not the Summary and Abstract sections, is intended to be used to interpret the claims. The Summary and Abstract sections may set forth one or more, but not all, exemplary embodiments of the present invention as contemplated by the inventor, and thus are not intended to limit the present invention and the appended claims in any way.

The present invention has been described above using acts and components to illustrate the implementation of specified functions and relationships thereof. The boundaries of these building blocks have been arbitrarily defined herein for the convenience of the description. Alternate boundaries can be defined so long as the specified functions and relationships thereof are appropriately performed. Furthermore, while the present invention is described herein with reference to illustrative embodiments for particular applications, it should be understood that the invention is not limited by them. Those skilled in the art with access to the teachings provided herein will recognize additional modifications, applications, and embodiments within the scope thereof and additional fields in which the invention would be of significant utility. Specific quantities and materials beyond what is specified and claimed herein, this specification not significantly adding to the functional originality of what is described and claimed, is considered well within the scope of one skilled in the art to determine.

The foregoing description of the specific embodiments will disclose the nature of the present invention so as to allow others, by applying knowledge within the skill of the art, to readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. The terminology and the way it is used in the present specification is for purpose of description and not limitation, and is to be interpreted by the skilled artisan in light of the herein presented teachings and guidance.

The breadth and scope of the present invention should not be limited by any of the above-described exemplary embodiments, but should be defined only in accordance with the following claims and their equivalents.

What is claimed is:

1. A method of reproducing imagery, comprising:

(a) representing each image area with a multi-digit binary number derived from its tonal value;

(b) dividing the binary number for each image area into separate bit planes for each digit;

(c) assigning a non-opaque ink to each bit plane, the concentration of the ink being proportional to the value of the bit plane's bit position within the binary number; and (d) printing all bit planes in register using their assigned inks.

2. The method of claim 1, wherein for printing (d) a reusable printing plate for each bit plane is created.

3. The method of claim 1, wherein the ink concentration (c) is set by diluting the ink.

4. The method of claim 1, wherein the ink concentration (c) is set by the number of ink droplets deposited onto a receptor layer.

5. The method of claim 1, wherein the ink concentration (c) is set by the ink droplet size deposited onto a receptor layer.

6. The method of claim 1, wherein the ink concentration (c) is set by removal of ink from a receptor layer into an another withdrawal receptor layer.

7. The method of claim 1, wherein (d) further comprises printing the image indirectly using at least one intermediate donor layer upon which ink is deposited prior to transfer to a final receptor layer.

8. The method of claim 7, wherein a donor layer also absorbs ink from a receptor layer.

9. The method of claim 7, further comprising a flat base to maintain contact and register between a donor and a receptor layer.

10. The method of claim 7, further comprising using one or more rollers bringing donor and receptor layers into contact for ink transfer.

11. The method of claim 7, wherein one or more edges of a donor layer is aligned to one or more edges of a receptor layer to maintain register during ink transfer.

12. The method of claim 7, wherein the ink concentration (c) is set by the transfer time between a donor layer and a receptor layer.

13. The method of claim 7, wherein the ink concentration (c) is set by the degree of heat during ink transfer.

14. The method of claim 7, wherein the ink concentration (c) is set by the relative heat difference between a donor layer and a receptor layer.

15. The method of claim 7, wherein the ink concentration (c) is set by measuring the current ink amount transferred from a donor layer to a receptor layer and terminating transfer when the desired ink amount is reached.

16. The method of claim 7, wherein the ink concentration (c) is set by the ink affinity of a receptor layer.

17. The method of claim 8, wherein the ink concentration (c) is set by the ink affinity of a donor layer.

18. The method of claim 8, wherein the ink concentration (c) is set by the relative ink affinity difference between a donor layer and a receptor layer.

19. The method of claim 16, wherein the ink affinity is set by an attractor in a receptor layer.

20. The method of claim 16, wherein the ink affinity is set by the elimination of ink attractors in a receptor layer.

21. The method of claim 16, wherein the ink affinity is set by the amount of an ink solvent in a receptor layer.

22. The method of claim 16, wherein the ink affinity is set by the relative ink solvent amount contained in a donor layer compared to the ink solvent amount contained in a receptor layer.

23. The method of claim 16, wherein the ink concentration (c) is set by the transfer time using a receptor layer that has a higher ink affinity than a donor layer.

24. The method of claim 17, wherein the ink affinity is set by the amount of an ink solvent in a donor layer.

25. The method of claim 1, wherein the ink concentration (c) is set by breaking up a bit plane into an intermittent pattern with a coverage that yields an effective virtual bit plane of lower bit significance than the full coverage ink concentration allows.

26. The method of claim 25, wherein multiple levels of intermittent coverage create multiple virtual bit planes that are all printed with the same real bit plane ink concentration (c).

27. The method of claim 26, wherein the ink concentration (c) used to create multiple virtual bit planes corresponds to the least significant real bit plane.

28. The method of claim 8, wherein the binary bit plane series of ink concentrations (c) are further comprised of:

(1) using donor and receptor layers both having an affinity for ink;

(2) transferring ink from multiple donor layers onto a single receptor layer in a succession commencing from the least significant bit plane and proceeding through bit planes of higher significance until finishing with the most significant bit plane; and (3) withdrawing part of the ink deposited by each previous ink transfer with each successive ink transfer in the sequence (2).

29. The method of claim 28, wherein the ink in (2) is at the same concentration in the donor layer before transfer for all bit planes.

30. The method of claim 28, wherein transfer and withdrawal of ink (3) take place simultaneously.

31. The method of claim 28, wherein donor layers and receptor layers (1) are of substantially equal ink affinity.

32. The method of claim 28, wherein successive donor layers (2) are of successively lower ink affinity than the receptor layer.

33. The method of claim 28, wherein the final donor layer is of low ink affinity compared to the receptor layer.

34. The method of claim 28, wherein the bit planes from all color primaries used in printing are simultaneously present in a donor layer, these present primaries being at the same level of bit significance.

35. The method of claim 34, wherein ink color primaries of different brightness but having the same or similar hue be assigned to different bit planes of the same binary bit plane series (b).

36. The method of claim 28, wherein the final donor layer is reused by being transferred onto a fresh receptor layer that has a total affinity for ink.

37. The method of claim 28, further comprising:

(i) selecting a donor layer to reuse;

(ii) determining the most significant bit plane present in (i);

(iii) printing or transferring directly onto the final receptor layer the mirror image of the next most significant bit plane (ii) relative to the donor layer selected in (i), this image being at the same ink concentration it would be prior to transfer in (2);

(iv) transferring the selected donor layer selected in (i) onto the final receptor layer; and (v) transferring onto the final receptor layer in order of increasing bit significance the ink bit planes more significant than the bit plane transferred in (iii).

* * * * *